US008958716B2

(12) United States Patent
Saito

(10) Patent No.: US 8,958,716 B2
(45) Date of Patent: Feb. 17, 2015

(54) IMAGE FORMING APPARATUS AND COOLING APPARATUS

(71) Applicant: Canon Kabushiki Kaisha, Tokyo (JP)

(72) Inventor: Shutaro Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 13/728,130

(22) Filed: Dec. 27, 2012

(65) Prior Publication Data

US 2013/0177332 A1 Jul. 11, 2013

(30) Foreign Application Priority Data

Jan. 11, 2012 (JP) ..... 2012-003022

(51) Int. Cl.
*G03G 15/20* (2006.01)

(52) U.S. Cl.
CPC .. *G03G 15/2021* (2013.01); *G03G 2215/00805* (2013.01)
USPC ..... 399/92

(58) Field of Classification Search
CPC ..... G03G 15/6576; G03G 15/2021; G03G 15/2017; G03G 21/206; G03G 2221/1645; G03G 2215/00662
USPC ..... 399/92, 328, 406
See application file for complete search history.

(56) References Cited

U.S. PATENT DOCUMENTS 5,732,309 A * 3/1998 Okuno et al. ..... 399/68
7,865,122 B2 * 1/2011 Koyama et al. ..... 399/341
2012/0273478 A1 11/2012 Saito

FOREIGN PATENT DOCUMENTS

JP 2008-112102 A 5/2008

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

An image forming apparatus, includes: an image heating device for heating an image on a sheet; a cooling belt for cooling the sheet in close contact with the sheet heated by the image heating device; a heat sink for cooling the cooling belt; a first fan for forming airflow in the heat sink; and a second fan for forming airflow in a space between the image heating device and the cooling belt.

22 Claims, 14 Drawing Sheets

IMAGE FORMING APPARATUS AND COOLING APPARATUS

FIELD OF THE INVENTION AND RELATED ART

The present invention relates to an image forming apparatus, for forming an image on a sheet, such as a copying machine, a printer, a facsimile machine or a multi-function machine having a plurality of functions of these machines. Further, the present invention relates to a cooling apparatus for cooling the sheet.

In a conventional image forming apparatus of an electrophotographic type, a process in which a toner image formed on the sheet (recording material) heated and pressed by a fixing device (image heating apparatus) to fix the toner image as a fixed image has been performed.

In this fixing process (step), heat is applied to the toner and the sheet, and therefore the water content (moisture) inside the sheet tends to evaporate in a process unit from which the sheet is discharged to the outside of the image forming apparatus. By a change in water content and stress exerted on the sheet due to the water content evaporation, these factors are is liable to cause waving or curling of the sheet. When the sheet is observed at a fiber level, the sheet is constituted by intermingled short fibers, so that the water content is contained in or between the fibers and thus the fibers and water form a hydrogen bond.

That is, when heat is applied to the sheet in the fixing process, the water content of the sheet evaporates, so that there is a possibility that the fibers form a hydrogen bond to deform the sheet. Then, when the sheet is left standing on a discharge tray, the moisture (water content) is absorbed by the sheet from ambient air, so that the hydrogen bond between the fibers is broken. However, the water content is not contained between parts of the fibers, so that the deformation of the sheet can be maintained. Such a deformation pattern is classified into a pattern in which the sheet is deformed by a difference in expansion and contraction between front and back surfaces of the sheet (curl) and a pattern in which the sheet is deformed by a difference in expansion and contraction between a widthwise central portion and end portion of the sheet. Due to these patterns of the deformation, waving and curling can occur.

In order to solve such a problem, in Japanese Laid-Open Patent Application (JP-A) 2008-112102 a constitution in which a cooling apparatus is provided downstream of the fixing device with respect to a sheet conveyance direction to cool the sheet having passed through the fixing device is proposed. In this cooling apparatus, a cooling operation is performed while nip-conveying the sheet between a pair of cooling belts. Specifically, a heat sink is provided inside one of the cooling belts, and the cooling belt is configured to quickly absorb heat applied from the sheet, thus dissipating the heat. In this way, by cooling the heated sheet by the fixing device in close contact with the sheet, the problem of sheet waving and curling is intended to be alleviated.

However, in order to more effectively suppress the occurrence of the curling and waving of the sheet, the use of the apparatus described in JP-A 2008-112102 is insufficient. Specifically, the sheet may preferably be cooled quickly before the water content of the sheet passes through the fixing device, so that the cooling apparatus is required to be disposed closely to the fixing device to the greatest extent possible. On the other hand, in the case where the cooling apparatus is provided in the very near neighborhood of the fixing device, the cooling apparatus is liable to receive the heat from the fixing device. As a result, the cooling apparatus is increased in temperature, so that there is a possibility that a sheet cooling efficiency is lowered. Therefore, in order to reduce the degree of water content evaporation of the sheet as soon as possible, the lowering in sheet cooling efficiency is required to be suppressed.

SUMMARY OF THE INVENTION

A principal object of the present invention is to provide an image forming apparatus and a cooling apparatus which are capable of suppressing a lowering in sheet cooling efficiency in order to reduce the degree of water content evaporation of a sheet.

According to an aspect of the present invention, there is provided an image forming apparatus, comprising: an image heating device for heating an image on a sheet; a cooling belt for cooling the sheet in close contact with the sheet heated by the image heating device; a heat sink for cooling the cooling belt; a first fan for forming airflow in the heat sink; and a second fan for forming airflow in a space between the image heating device and the cooling belt.

According to another aspect of the present invention, there is provided an image forming apparatus, comprising: an image heating device for heating an image on a sheet; a cooling belt for cooling the sheet in close contact with the sheet heated by the image heating device; a heat sink for cooling the cooling belt; a first duct for guiding the airflow into the heat sink; and a second duct for guiding the airflow into the space between the image heating device and the cooling belt; and a fan for sending air to the first duct and the second duct.

According to a further aspect of the present invention, there is provided a cooling apparatus for cooling a sheet in close contact with the sheet; a duct for guiding airflow into a space between the cooling apparatus and the image heating apparatus; and a fan for sending air into the duct.

These and other objects, features and advantages of the present invention will become more apparent upon a consideration of the following description of the preferred embodiments of the present invention taken in conjunction with the accompanying drawings.

Figure 4:
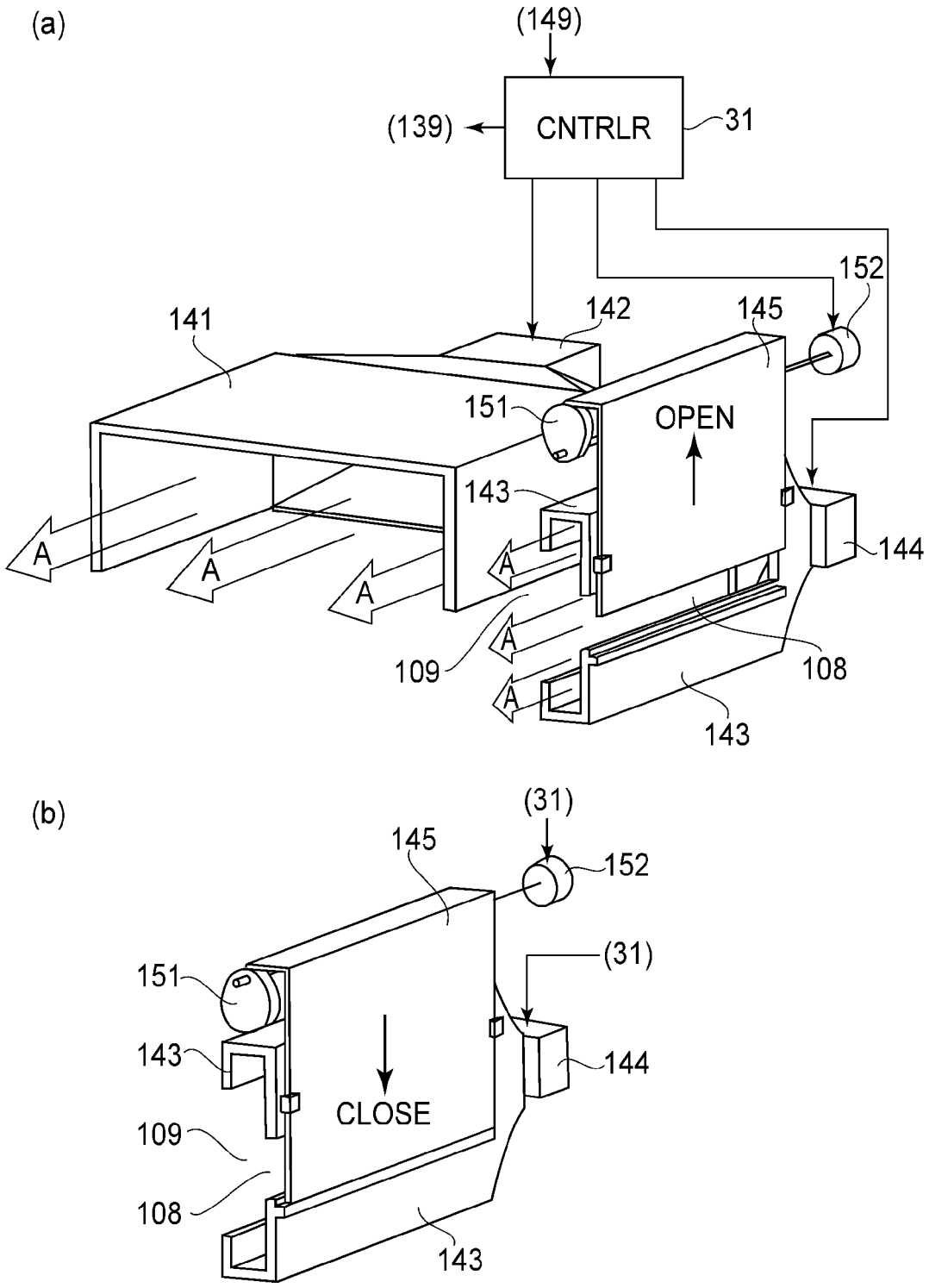

Parts (a) and (b) of FIG. 4 are schematic illustrations of a shutter opening and closing mechanism.

Figure 5:
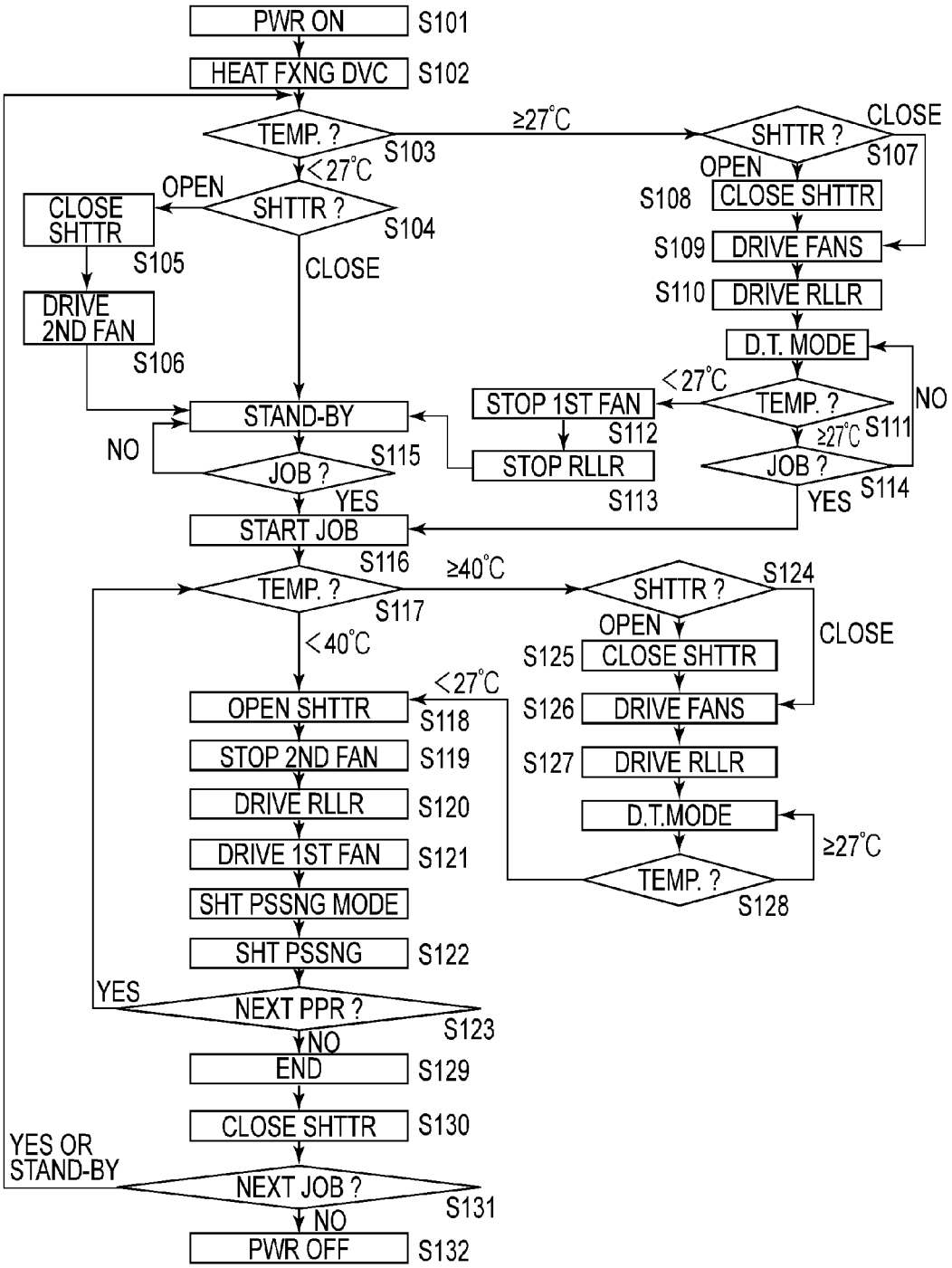

FIG. 5 is a flow chart of an airflow control system in Embodiment 1.

Figure 6:
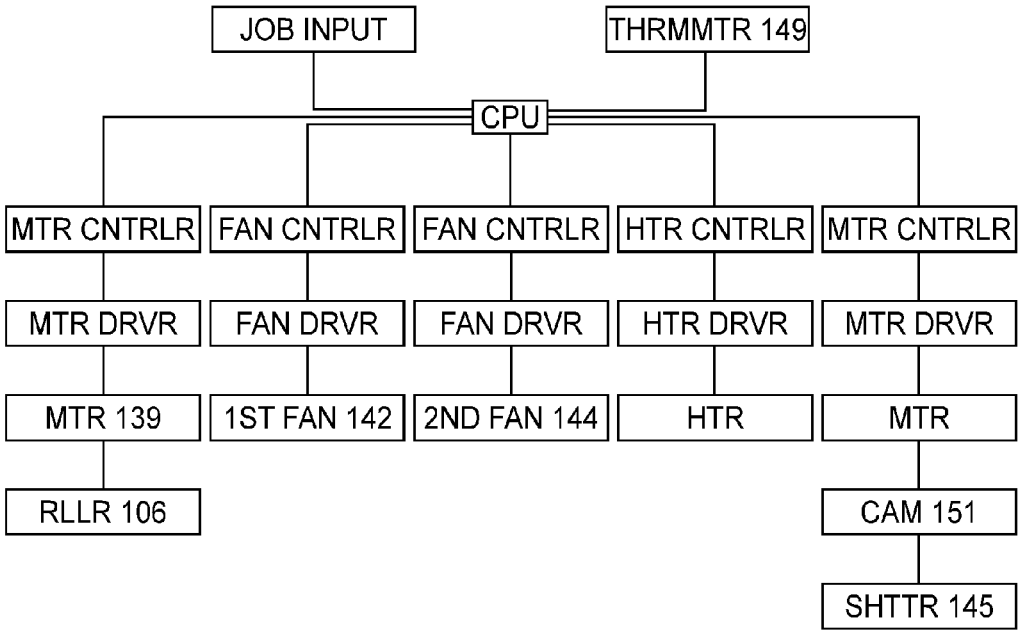

FIG. 6 is a block diagram of the airflow control system in Embodiment 1.

Figure 7:
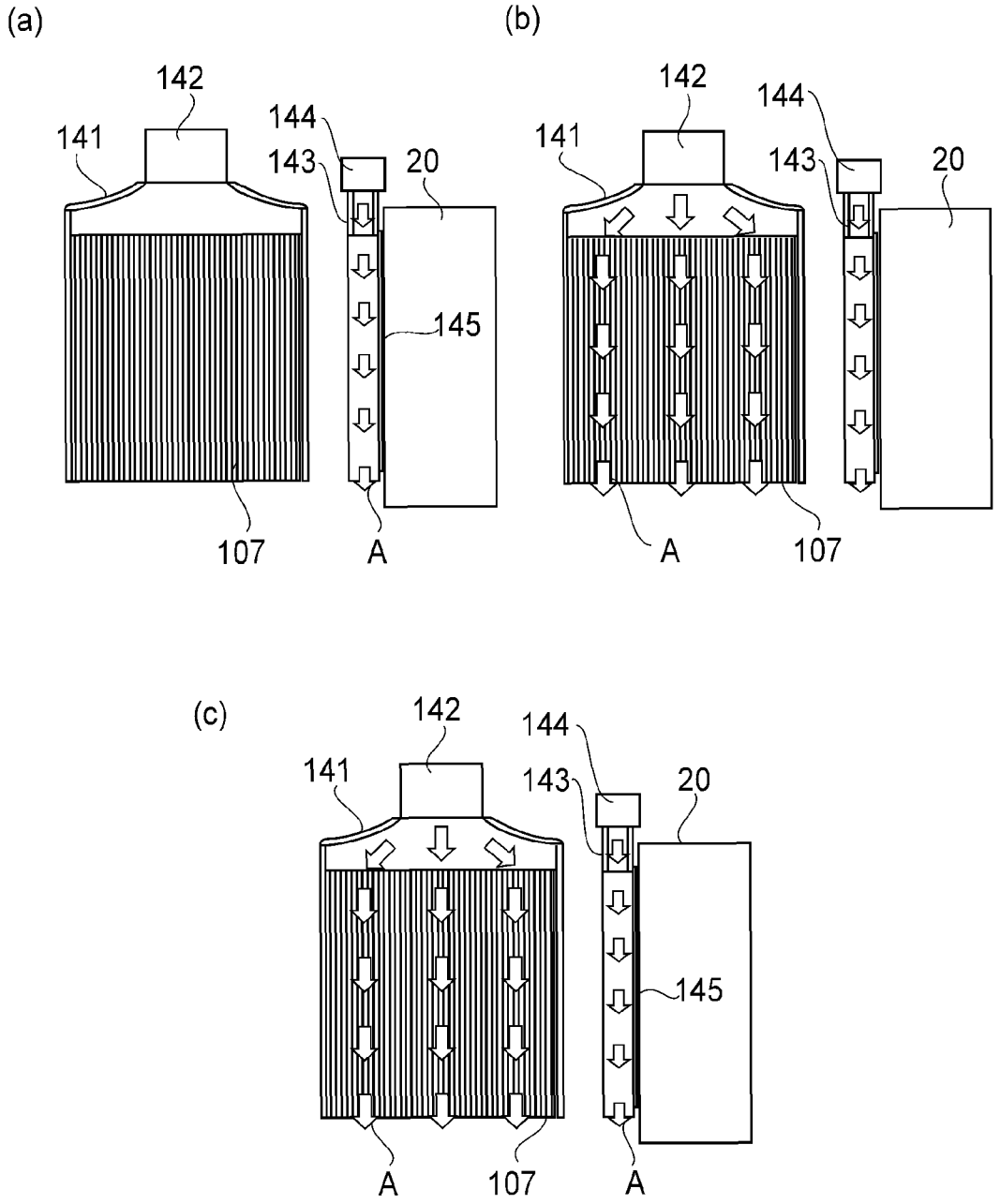

FIGS. 7(*a*), 7(*b*), and 7(*c*) are sectional views for illustrating air flow in Embodiment 1.

Figure 8:
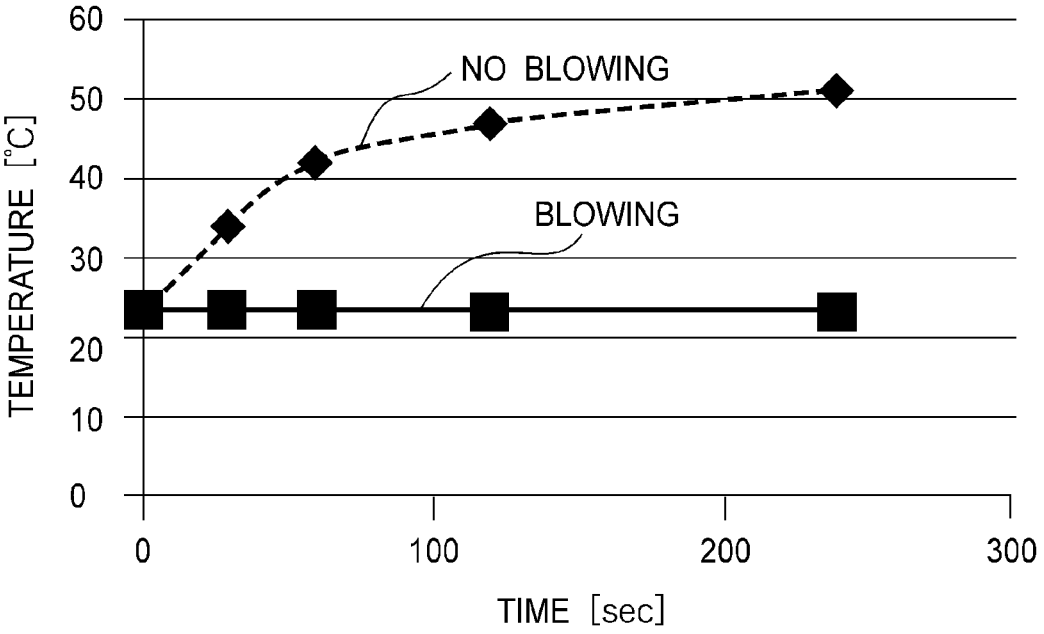

FIG. 8 is a graph showing a temperature rise suppressing effect of the cooling apparatus.

Figure 9:
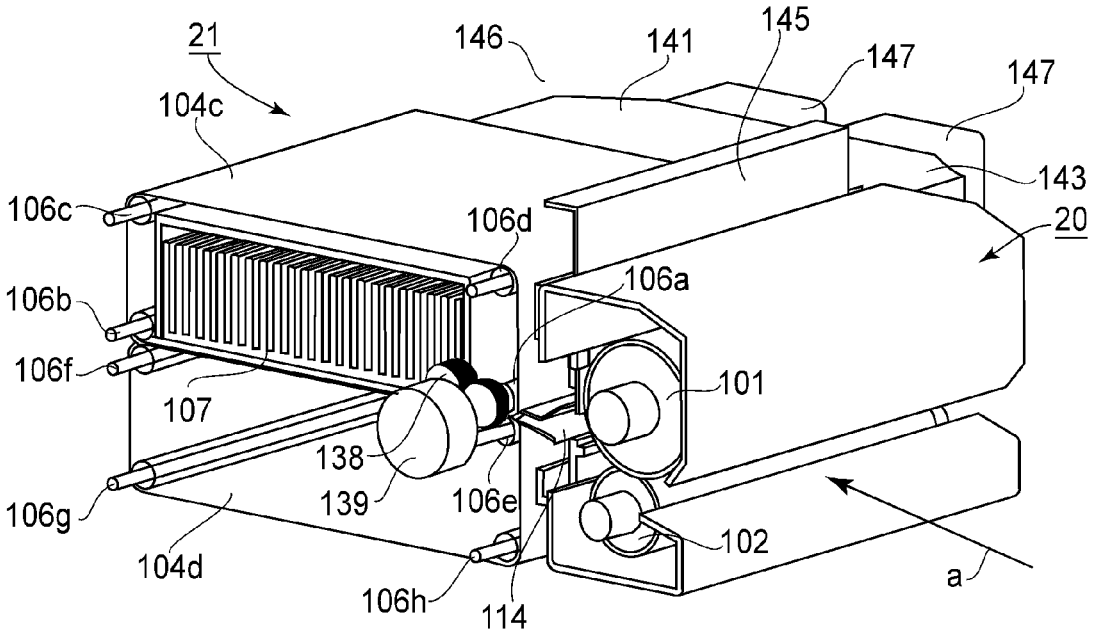

FIG. 9 is a perspective view of an outer appearance of a principal part of a fixing device and a cooling apparatus in Embodiment 2.

Figure 10:
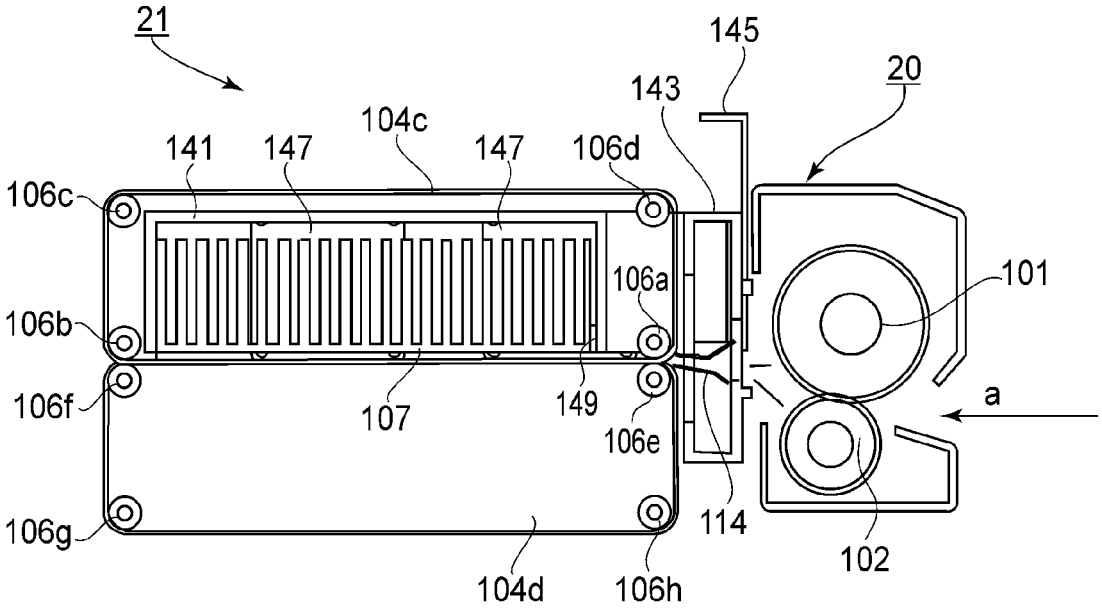

FIG. 10 is a schematic side view of the principal part of the fixing device and the cooling apparatus in Embodiment 2.

Figure 11:
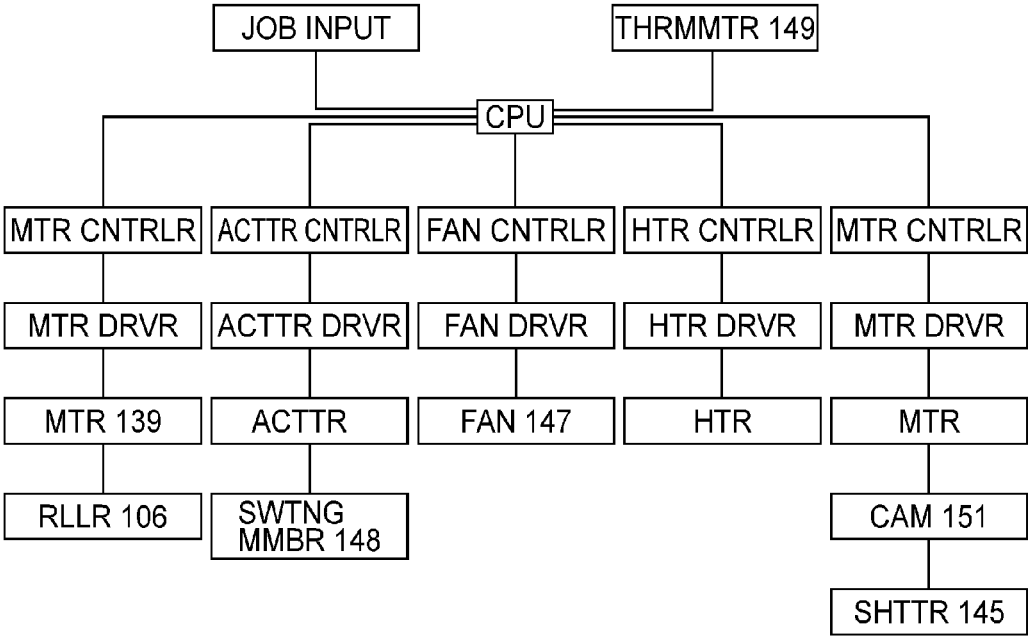

FIG. 11 is a block diagram of an airflow control system in Embodiment 2.

Figure 12:
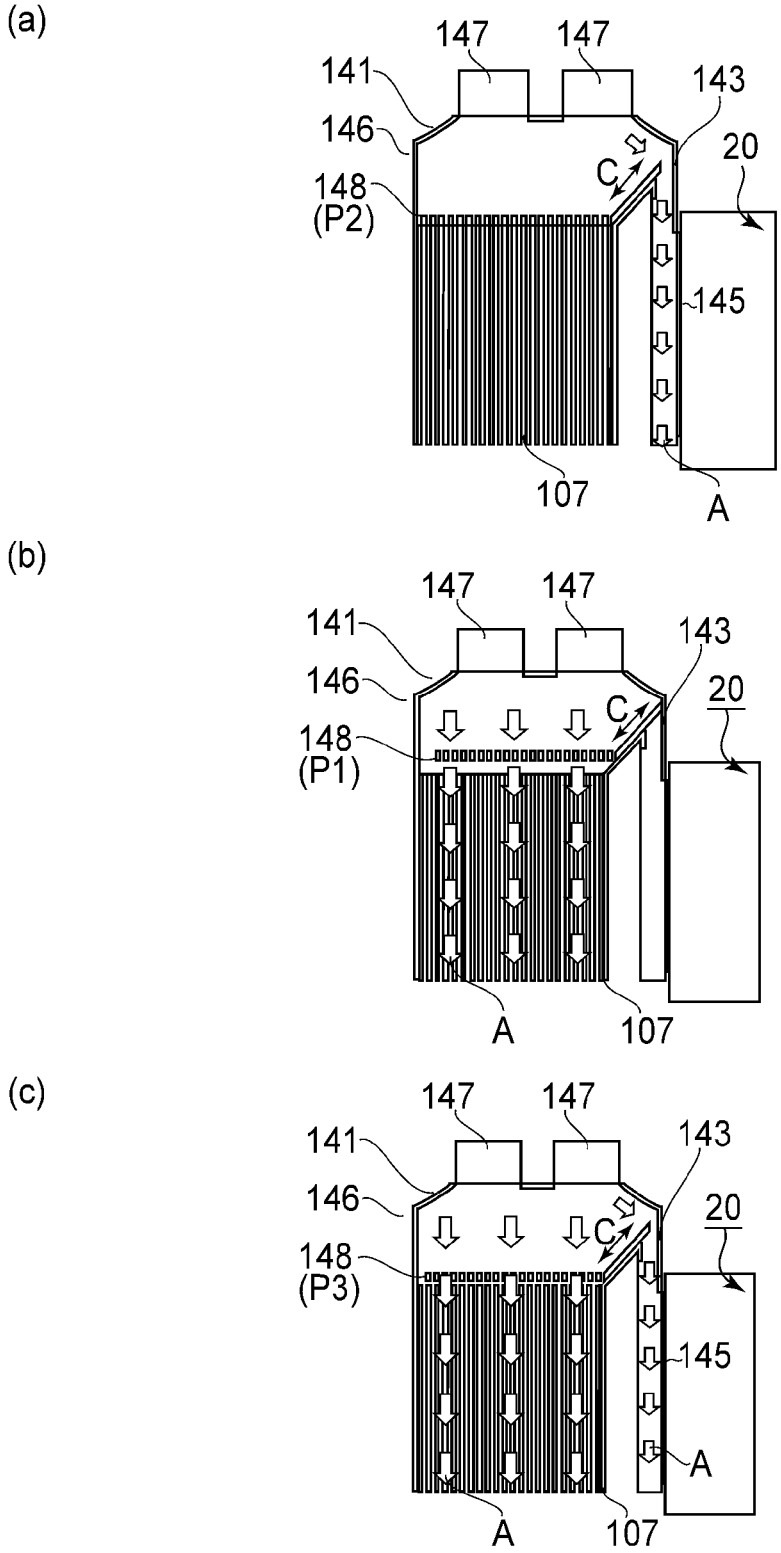

FIGS. 12(*a*), 12(*b*), and 12(*c*) are sectional views for illustrating airflow in Embodiment 2.

Figure 13:
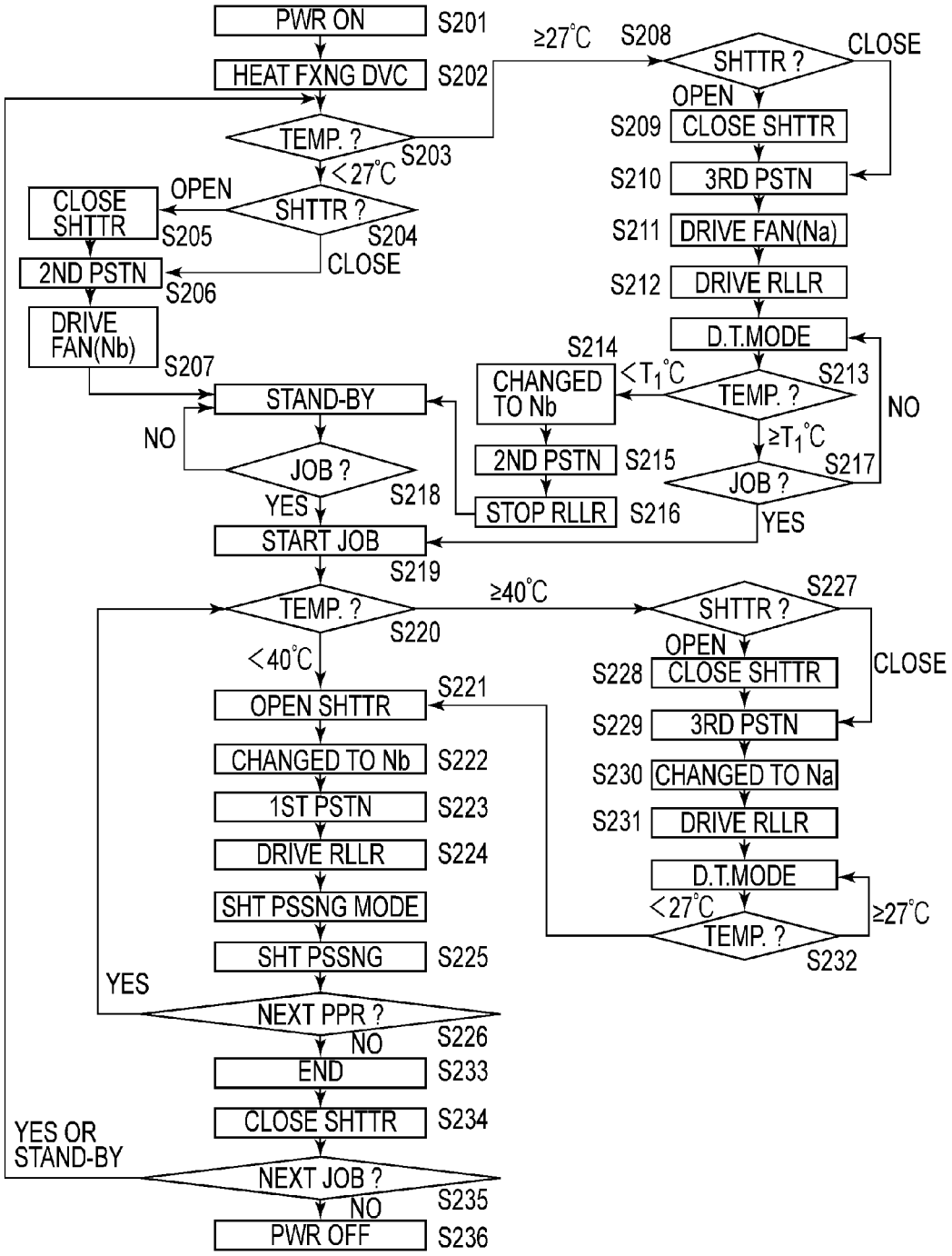

FIG. 13 is a flow chart of the airflow control system in Embodiment 2.

Figure 14:
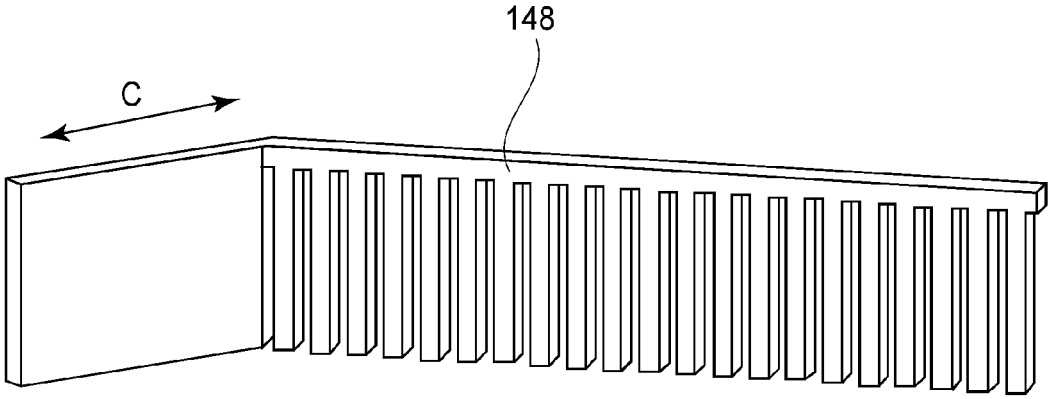

FIG. 14 is a schematic perspective view of an airflow switching member in Embodiment 2.

DESCRIPTION OF THE PREFERRED EMBODIMENTS

Embodiment 1

(1) Image Forming Apparatus

Figure 1:
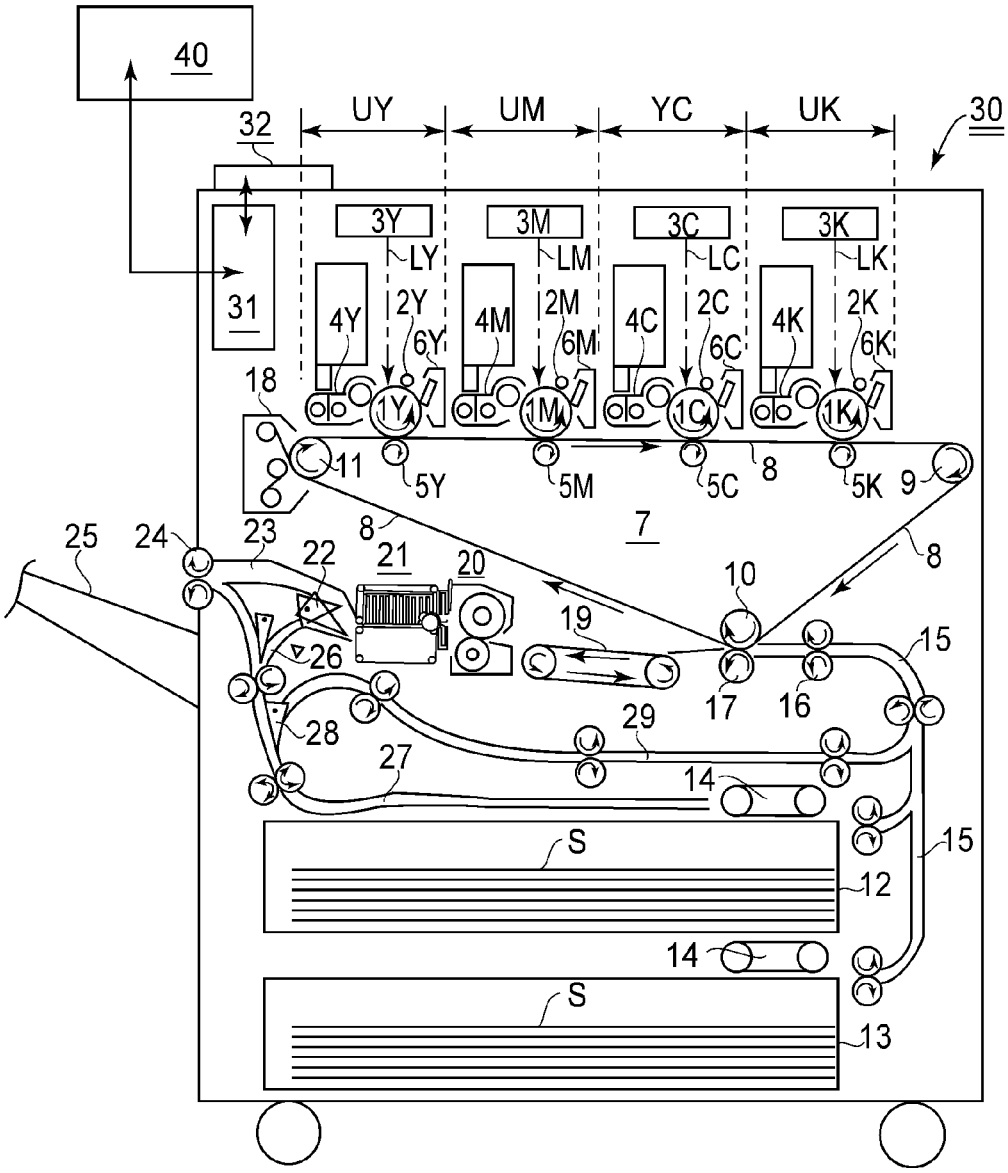
FIG. 1 is a schematic illustration of an image forming apparatus in Embodiment 1.

FIG. 1 is a schematic illustration of an example of an image forming apparatus according to the present invention. An image forming apparatus 30 is an electrophotographic full-color (natural colors, multi-colors) laser beam printer of a tandem type and an intermediary transfer type. On the basis of an image signal inputted from a host device 40, such as a personal computer, into a control circuit portion (selector) 31, a four color-based, full-color image can be formed on a recording material (sheet) S. The recording material S is a sheet-like recording medium on which a developer image (toner image) can be formed, and is plain paper, glossy paper, an envelope, a postcard, a label, an OHP sheet, and the like.

The control circuit portion 31 transfers various pieces of electrical information between the host device 40 and an operating portion 32 including various operation keys and a developing device. Further, the control circuit portion 31 monitors and controls operations of various devices in the apparatus 30 and effects integrated control of an image forming operation of the apparatus 30 in accordance with a predetermined control program or a reference table.

In the apparatus 30, in the figure, first to fourth image forming portions U (UY, UM, UC and UK) are juxtaposed in series in this order from a left side to a right side in a horizontal direction, so that respective color developer images are formed by parallel processing. The respective image forming portions U are electrophotographic image forming mechanisms having the same constitution except that colors of developers (toners) accommodated in associated developing devices are yellow (Y), magenta (M), cyan (C) and black (K), respectively, which are different colors.

The constitution and operations of the respective image forming portions UY, UM, UC and UK are common to each other in many cases. Therefore, in the following description, in the case where a particular differentiation is not required, suffixes Y, M, C and K added for representing elements provided for associated colors are omitted, and the elements for the respective colors will be collectively described.

Each image forming portion U includes a photosensitive drum 1 as a rotatable image bearing member for forming an electrostatic latent image on its surface. The drum 1 is rotationally driven in an arrow direction (counterclockwise direction) at a predetermined speed. At a periphery of the drum 1, along a rotational direction of the drum 1, a primary charging device (roller) 2, an exposure device (laser scanner unit 3), a developing device 4, a primary transfer device (roller) 5 and a cleaning device 6 are provided.

To the primary charging device 2, a predetermined charging bias is applied. As a result, the surface of the rotating drum 1 is electrically charged uniformly to a predetermined polarity and a predetermined potential. The unit 3 outputs a laser beam L whose modulation depends on the image information inputted from the host device 40 into the control circuit portion 31, thus subjecting the charged surface of the drum 1 to scanning exposure. As a result, on the surface of the drum 1, the electrostatic latent image corresponding to the image exposure is formed. The electrostatic latent image is developed as a toner image by the developing device 4.

By an image forming process including the charging, the exposure and the development as described above, a Y toner image corresponding to a Y-component image for a full-color image is formed on the drum 1Y of the first image forming portion UY. An M toner image corresponding to an M component image for the full-color image is formed on the drum 1M of the second image forming portion UM. A C toner image corresponding to a C component image for the full-color image is formed on the drum 1C of the third image forming portion UC. A K toner image corresponding to a K component image for the full-color image is formed on the drum 1K of the fourth image forming portion UK.

An intermediary transfer belt unit 7 provided under the first to fourth image forming portions U includes a flexible endless intermediary transfer belt 8 as an intermediary transfer member which is circulated and moved to be successively subjected to toner image transfer from the drums 1 of the respective image forming portions U. The belt 8 is stretched around three rollers consisting of a driving roller 9, a secondary transfer opposite roller 10 and a tension roller 11. The belt 8 is rotationally driven in an arrow direction (clockwise direction) at the substantially same speed as that of the drum 1.

The primary transfer device (roller) 5 of each image forming portion U is press-contacted to a lower surface of the belt 9 toward the drum 1. A contact portion between the drum 1 and the belt 8 is a primary transfer nip. By applying a predetermined primary bias to the roller 5, the toner image is primary-transferred from the drum 1 onto the surface of the belt 8 at the primary transfer nip. A residual toner remaining on the drum 1 is removed from the drum surface by the cleaning device 6. The toner image formation on the drum 1 of each image forming portion U is controlled so that the toner images are successively primary-transferred from the drums 1 of the respective image forming portions U onto the belt 8 in a predetermined superposition state.

Thus, on the surface of the belt 8 passing through the primary transfer nip of the four image forming portion UK, a full-color unfixed toner images including superposed four color toner images of Y, M, C and K is synthetically formed. A secondary transfer device (roller) 17 is press-contacted to the belt 8 toward the roller 10. A contact portion between the roller 17 and the belt 8 is a secondary transfer nip. The toner images formed on the belt 8 are conveyed to the secondary transfer nip by further movement of the belt 8.

On the other hand, sheets of the recording material S stacked and accommodated in a first sheet feeding cassette 12 or a second sheet feeding cassette 13 are separated and fed one by one by driving a sheet feeding unit 14 for the first and second sheet feeding cassettes 12 and 13. The sheet S passes through a first sheet path 15 and then is guided into the secondary transfer nip by a registration roller pair 16 at predetermined control timing. As a result, the sheet S is nip-conveyed through the secondary transfer nip and at the same time, the toner images are successively secondary-transferred collectively from the belt 8 onto the sheet S by a predetermined secondary transfer bias applied to the roller 17.

The sheet S having passed through the secondary transfer nip is separated from the belt 8 and then is guided into a fixing device (fixing apparatus) 20 as an image heating apparatus (image heating portion) by a conveyer belt device 19. Residual toner remaining on the belt 8 is removed from the belt surface by a cleaning device 18 provided at a belt contacting portion of the roller 11. The sheet S is heated and pressed by the fixing device 20. As a result, the unfixed toner image is fixed as a fixed image on the sheet surface by thermocompression. The image forming mechanism portion until the sheet S reaches the fixing device 20 is the image forming portion for forming and carrying the unfixed toner image on the sheet S.

The sheet S coming out of the fixing device (image heating apparatus or image heating device) 20 is guided into a recording material cooling apparatus (recording material cooling portion) 21 provided adjacent to the fixing device 20, thus being subjected to cooling. The fixing device 20 and the cooling apparatus 21 will be described specifically in (2) and (3) appearing hereinafter.

In the case where a one-side image forming mode is selected, the sheet S coming out of the cooling apparatus 21 is guided to a second sheet path 23 by switching control of a flapper 22, so that the sheet S is discharged onto a discharge tray 25 outside the image forming apparatus by a discharging roller 24.

In the case where a both-side image forming mode is selected, the sheet S, which comes out of the cooling apparatus 21 and on which the image is formed on a first surface thereof, is guided to a third sheet path 26 by the switching control of the flapper 22. Then, the sheet S enters a switchback sheet path 27 and then is pulled out from the sheet path 27 and is guided to a conveying sheet path 29 for both-side image formation by switching control of a flapper 28. Then, the sheet S passes through the sheet path 29 and is guided to the first sheet path 15 again, and thereafter is guided again to the secondary transfer nip by the registration roller pair 16 at predetermined timing in an upside-down state.

As a result, the toner images are secondary-transferred from the belt 8 onto a second surface of the sheet S. The sheet S subjected to the secondary transfer of the toner images on the second surface of the sheet S at the secondary transfer nip is separated from the belt 8 and is guided again into the fixing device 20 and the cooling apparatus 21 successively, thus being subjected to the fixing process of the image and the cooling process of the sheet S. Then, the sheet S passes through the second sheet path 23 and is discharged as a both-side image-formed product onto the tray 25.

An operation in a monochromatic mode is performed by an image forming operation of the image forming portion for a designated color. At other image forming portions, rotation of the drums is performed, but the image forming operation is not performed. Incidentally, the order of the arrangement of the respective color image forming portions is not limited to that in this embodiment, i.e., the order of Y, M, C and K but may also be appropriately changed to an arbitrary order. Further, the number of the image forming portions in the full-color image forming apparatus is not limited to four as in this embodiment. The image forming apparatus may also be single-color image forming apparatus such as a monochromatic image forming apparatus including a single image forming portion.

(2) Fixing Device 20

Figure 2:
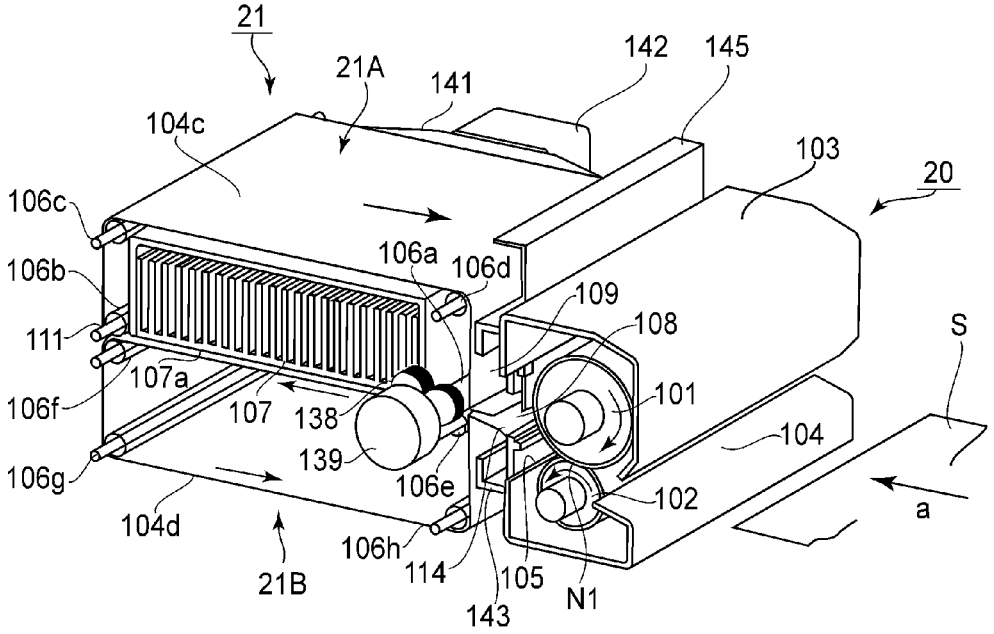
FIG. 2 is a perspective view of an outer appearance of a principal part of a fixing device and a cooling apparatus.
Figure 3:
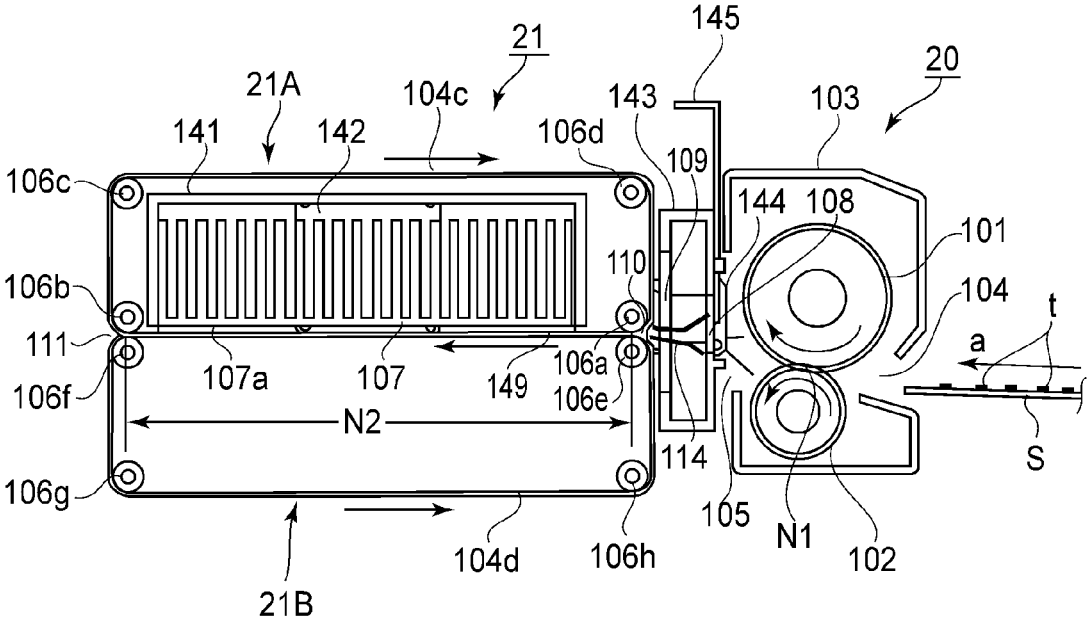
FIG. 3 is a schematic view of the principal part of the fixing device and the cooling apparatus.

FIG. 2 is a perspective view of an outer appearance of a principal part of the fixing device 20 as the image heating apparatus (image heating device) and the cooling apparatus 21 provided adjacent to the fixing device 20, and FIG. 3 is a schematic side view of the principal part of the fixing device 20 and the cooling apparatus 21. The fixing device 20 includes, in a fixing device casing 103, a fixing roller 101 and an elastic pressing roller 102 provided vertically in parallel as first and second fixing members. Each of the fixing roller 101 and the pressing roller 102 is rotatably shaft-supported between a side plate (not shown) and another side plate (not shown) of the fixing device casing 103.

The pressing roller 102 is press-contacted to the fixing roller 101 by an urging means (not shown) with a predetermined urging force, so that a fixing nip N1 with a predetermined width with respect to a recording material conveyance direction a is formed. The fixing roller 101 is rotationally driven in an arrow direction (clockwise direction) at a predetermined speed by a driving means (not shown). The pressing roller 102 is rotated in an arrow direction (counterclockwise direction) by the rotation of the fixing roller 101.

The fixing roller 101 is internally heated by energizing an inside heat source (not shown) such as a halogen heater, so that its surface temperature is increased up to a predetermined temperature and is temperature-controlled by a temperature-controlling means (not shown).

In a state the fixing roller 101 is rotationally driven and its surface temperature is temperature-controlled at a predetermined fixing temperature (image heating temperature), the sheet S on which the unfixed toner image t is carried is conveyed from the image forming portion side to the fixing device 20. Then, the sheet S is guided from a sheet entrance portion 104 of the fixing device casing 103 into the fixing device 20. The sheet S enters the fixing nip N1 with an image-carried surface toward the fixing roller 101 and is nip-conveyed at the fixing nip N1. As a result, the unfixed toner image t on the sheet surface is heated and pressed by heat and nip pressure to be fixed as a fixed image.

The sheet S coming out of the fixing nip N1 is conveyed to the outside of the fixing device 20 from a sheet exit portion 105 of the fixing device casing 103, and then is guided by a conveying guide 114 into the cooling apparatus 21 adjacent to the fixing device 20.

(3) Cooling Apparatus 21

The cooling apparatus 21 is an apparatus (device) for quickly cooling, in order to alleviate the problem of the degree of curling and waving of the sheet S coming out of the fixing device 20, the cooling being performed on the sheet S immediately after the sheet S is sent out from the fixing device 20 and is still placed in a sufficiently heated state. The cooling apparatus 21 is provided near to the fixing device 20 as close as possible downstream of the fixing device 20 with respect to the sheet conveyance direction a.

The cooling apparatus 21 includes an upper unit 21A and a lower unit 21B, which from a cooling nip N2 where the sheet S conveyed from the fixing device 20 is to be nip-conveyed and cooled. The upper and lower units 21A and 21B include flexible endless belts 104*c* and 104*d*, respectively, as rotatable members. Each of the belt (cooling belt) 104*c* and the belt (conveying belt) 104*d* is formed with a polyimide (PI) film or the like excellent in thermal conductivity and has a hermetically sealed layer with less minute pores. A belt width (belt dimension with respect to a direction perpendicular to the sheet conveyance direction a) of each of the belts 104*c* and 104*d* is larger than a maximum sheet passing width of the sheet S in the fixing device.

The upper unit 21A includes four stretching rollers 106*a* to 106*d* as supporting members for supporting the belt 104*c* so that the belt 104*c* is stretched around the rollers 106*a* to 106*d* in a substantially horizontally elongated rectangular shape when the belt 104*c* is viewed from its side surface. Similarly, the lower unit 21B includes four stretching rollers 106*e* to

106*h* as supporting members for supporting the belt 104*d* so that the belt 104*d* is stretched around the rollers 106*e* to 106*h* in a substantially horizontally elongated rectangular shape when the belt 104*d* is viewed from its side surface. In the upper and lower units 21A and 21B, the stretching rollers 106*a* and 106*e* are contacted to the belts 104*c* and 104*d* to urge them toward each other with a predetermined urging force, and the stretching rollers 106*b* and 106*f* are contacted to the belts 104*c* and 104*d* toward each other with a predetermined urging force.

As a result, an outer surface of a belt portion, between the stretching rollers 106*a* and 106*b*, of the belt 104*c* of the upper unit 21A and an outer surface of a belt portion, between the stretching rollers 106*e* and 106*f*, of the belt 104*d* of the lower unit 21B are closely contacted to each other. By this close contact, a wide cooling nip N2 is formed with respect to the sheet conveyance direction a. In this embodiment, the cooling nip N2 of, e.g., about 400 μm is formed. At the cooling nip N2, the sheet S which has passed through the fixing device 20 and is in the heated state is cooled in a hermetically sealed state (hermetically sealed cooling) while being nip-conveyed. That is, the sheet S is conveyed in a hermetically contact state with the belts 104*c* and 104*d*.

Inside the belt 104*c* of the upper unit 21A, a heat sink 107 as a cooling member for cooling the belt 104*c* is provided. In this embodiment, a flat cooling plate 107*a* of the heat sink 107 is hermetically contacted to an inner surface of the belt portion of the belt 104*c* between the stretching rollers 106*a* and 106*b*, thus cooling the belt portion. That is, the heat sink 107 is configured to sandwich the belt 104*c* between itself and the belt 104*d*. In this embodiment, the flat cooling plate 107*a* of the heat sink 107 is hermetically contacted to the belt 104*c* in a major range of, e.g., 340 mm of the width (about 400 mm) of the cooling nip N2, thus cooling the belt 104*c*.

In this embodiment, the stretching roller 106*a* of the upper unit 21A is a driving roller, to which a driving force of a driving motor 139 is transmitted via a driving gear train. As a result, the belt 104*c* of the upper unit 21A is rotationally driven in an arrow direction (clockwise direction) at a predetermined speed. The belt 104*d* of the lower unit 21B is rotated in an arrow direction (clockwise direction) by the rotation of the belt 104*c* through a frictional force between itself and the belt 104*c* at the cooling nip N2.

The cooling apparatus 21 includes a thermometer (temperature sensor) 149 for detecting a temperature of the belt 104*c* (heat sink 107). The thermometer 149 is provided, e.g., close to the fixing device 20 and in the neighborhood of an upstream entrance of the heat sink 107 where the sheet S higher in temperature is to be passed through, and detects the temperature. Detected temperature information (electrical information on temperature) of the thermometer 149 is inputted into the control circuit portion 31.

In the cooling apparatus 21, the sheet S, which has passed through the fixing device 20 and is still placed in the sufficiently heated state, is guided by the conveying guide 114 to be introduced from a sheet entrance portion 110 in a side of the stretching rollers 106*a* and 106*e* into the cooling nip N2 in a state in which the belts 104*c* and 104*d* are rotated. At the cooling nip N2, the sheet S is conveyed and cooled in the hermetically sealed state. By this hermetically sealed cooling, the belts 104*c* and 104*d* cooled by the heat sink 107 quickly absorb the heat applied from the sheet S and then dissipate the heat. Further, the belts 104*c* and 104*d* nip the sheet S and convey the sheet S in a plane.

The sheet S cooled in the hermetically sealed state while being conveyed at the cooling nip N2 is sent out from a sheet exit portion 111 in a side of the stretching rollers 106*b* and 106*f*. Thus, the sheet S which has passed through the fixing device 20 and is in the heated state is quickly cooled in the hermetically sealed state, so that the water content evaporation of the sheet S is prevented, alleviating the problem of the waving and curling of the sheet.

The cooling apparatus 21 includes a first air blow path (duct) 141 for forming airflow to the heat sink 107 and a first fan 142 for sending gas (air) to the first air blow path 141. Further, in a space between the cooling apparatus 21 and the fixing device 20, a second air blow path for forming airflow and a second fan for sending the gas to the second air blow path 143 are provided.

FIG. 4(*a*) is a perspective view showing the first air blow path 141, the first fan 142, the second air blow path 143, and the second fan 144.

The first air blow path (duct) 141 surrounds the heat sink 107 inside the belt 104*c* in a front side, an upper side and a rear side of the heat sink 107. In a side and another side of the air blow path 141 with respect to a widthwise direction (perpendicular to the sheet conveyance direction a), the air blow path 141 is open as an opening. The first fan 142 sends the air (outside air) into the air blow path 141 through the opening of the air blow path in the side. As a result, airflow A flowing from the opening in the side to the opening in another side is formed in the air blow path 141. By the airflow A, the heat sink 107 in the air blow path 141 is air-cooled, so that the heat conducted from the sheet S to the heat sink 107 via the belt 104*c* is dissipated.

In the front side of the second air blow path 143 (facing the fixing device 20), a sheet entrance portion 108 communicating with the sheet exit portion 105 of the fixing device 20 is provided. Further, in the rear side of the second air blow path 143 (facing the cooling apparatus 21), a sheet exit portion 109 communicating with the sheet entrance portion 110 of the cooling apparatus 21 is provided. In the second air blow path 143, between the sheet entrance portion 108 and the sheet exit portion 109, the sheet conveying guide 114 for guiding the sheet S coming out of the fixing device 20 to the sheet entrance portion 110 of the cooling apparatus 21 is provided.

The air blow path 143 opens as an opening in each of a side and another side thereof with respect to the widthwise direction (perpendicular to the sheet conveyance direction a) thereof. The second fan 144 sends the air (outside air) into the air blow path 143 through the opening in the side of the air blow path 143. As a result, airflow A flowing from the opening in the side to the opening in another side is formed in the air blow path 143. In this embodiment, the first fan is larger in output than the second fan (e.g., output ratio of 9:1).

Further, in the front side of the second air blow path 143, a movable shutter 145 for opening and closing the sheet entrance portion 110 communicating with the sheet exit portion 105 of the fixing device 20 is provided. This shutter 145 is capable of opening and closing the recording material conveyance path between the fixing device 20 and the cooling apparatus 21. Further, a shutter opening/closing cam 151 for moving the shutter 145 to open and closed positions and a motor 152 for driving the shutter opening/closing cam 151 are provided.

A motor 152 is controlled by the control circuit portion 31 so that the cam 151 is held at a rotation angle position (attitude) where a major portion of the cam 151 is directed upward as shown in FIG. 4(*a*), so that the shutter 145 is moved upward to maintain the sheet entrance portion 110 in the open state. That is, the recording material conveyance path between the fixing device 20 and the cooling apparatus 21 is kept in the open state, so that the recording material S is capable of being guided from the fixing device 20 into the cooling apparatus 21.

Further, the motor 152 is controlled by the control circuit portion 31 so that the cam 151 is held at a rotation angle position (attitude) where a minor portion of the cam 151 is directed upward as shown in FIG. 4(*b*), so that the shutter 145 is moved downward to maintain the sheet entrance portion 110 in the closed state. That is, the recording material conveyance path between the fixing device 20 and the cooling apparatus 21 is blocked by the shutter 145.

The control circuit portion 31 effects air blow control (airflow control) of the first and second air blow paths 141 and 143 depending on a job state of the image forming apparatus 30. That is, the control circuit portion 31 selectively controls the first fan 141 and the second fan 143, thus effecting control for selectively changing the airflow to the first air blow path 141 and the second air blow path 143. An airflow control system in this embodiment will be described below.

In the airflow control in this embodiment, the airflow to the first air blow path 141 and the airflow to the second air blow path 143 is switched depending on control modes, of the image forming apparatus 30, consisting of:

a) stand-by mode (stand-by mode in which the image forming apparatus stands by for instructions of image formation), b) sheet passing mode (state in which the image is formed), and c) down time mode (state in which the image formation is interrupted).

The switching between driving of the first fan 142 and driving of the second fan 144 in each of the control modes will be described. The switching is controlled by the control circuit portion (selector) 31.

a) Case of Stand-by Mode

The stand-by mode is a control mode during a state in which a main power (source) switch (not shown) of the image forming apparatus 30 is turned on and then the control circuit portion 31 awaits input of an image formation start signal (print start signal: operation start signal), i.e., waits a job.

During the operation in the stand-by mode, driving of the image forming portion is stopped. In the fixing device 20, a driving means is turned off, so that rotation of the fixing roller 101 and rotation of the pressing roller 102 are stopped. The fixing roller 101 is internally heated by energization to the inner heat source and thus its surface temperature is increased up to a predetermined stand-by temperature, so that the fixing roller 101 is temperature-controlled at the predetermined stand-by temperature by a temperature control means.

In the cooling apparatus 21, the driving motor 139 is turned off, so that rotation of the belt 104*c* and rotation of the belt 104*d* are stopped, i.e., rotational speeds of the rotatable members are zero. The shutter 145 is closed, so that the recording material conveyance path between the fixing device 20 and the cooling apparatus 21 is blocked. The first fan 142 is turned off, but the second fan 144 is turned on.

That is, during the operation in the stand-by mode, only the second fan 144 is driven. In the operation in the stand-by mode, the heat sink 107 itself is sufficiently cooled, and therefore there is no need to drive the first fan 142. Thus, the driving of the first fan 142 can be stopped, and therefore unnecessary electric power consumption can be reduced. Further, it is possible to reduce unnecessary airflow formed in the main assembly of the image forming apparatus.

b) Case of Sheet Passing Mode

The sheet passing mode is a control mode in the case where the image formation start signal is inputted into the control circuit portion 31. In the sheet passing mode, the image forming portion is driven and the sheet S is passed, so that the unfixed toner image is formed on the sheet S.

In the fixing device 20, a driving means is turned on, so that the fixing roller 101 and the pressing roller 102 are rotated. The surface temperature of the fixing roller 101 is increased up to a predetermined fixing temperature, and then is temperature-controlled at the predetermined fixing temperature by the temperature control means.

In the cooling apparatus 21, the driving motor 139 is turned on, so that the belt 104*c* and the belt 104*d* are rotated. The shutter 145 is opened, so that the blocking of the recording material conveyance path between the fixing device 20 and the cooling apparatus 21 is eliminated. The first fan 142 is turned on, and the second fan 144 is turned off.

That is, during the operation in the sheet passing mode, only the first fan 142 is driven to cool the heat sink 107.

c) Case of Down Time Mode

The down time mode is a control mode in which an operation of the image forming portion (apparatus operation) is temporarily stopped (interrupted) in the case where the temperature of the cooling apparatus (cooling portion) 21 is increased to not less than a predetermined upper-limit temperature, and the image forming apparatus detects a decrease in the temperature of the cooling apparatus 21.

In the case of an operation in the down time mode, the shutter 145 is closed. Then, both of the first fan 142 and the second fan 144 are driven to cool the heat sink 107 (cooling apparatus 21) and also to prevent conduction of heat from the fixing device 21 to the cooling apparatus 21.

During the operation in the down time mode, the heat sink 107 is increased in temperature and therefore it is important to cool the heat sink 107. However, the operation of the image forming portion is temporarily stopped and sheet passing is not effected. Therefore, the proportion of the quantity of heat, received by the cooling apparatus 21 by heat conduction from the fixing device 20, to the quantity of heat necessary to be reduced for cooling the heat sink 107 becomes high. For that reason, the airflow is formed in the second air blow path 144 by using the second fan 144, so that the heat conduction from the fixing device 20 to the cooling apparatus 21 is prevented.

FIGS. 5 and 6 are flow chart and a block diagram, respectively, of the airflow control system in this embodiment. Further, FIGS. 7(*a*) to 7(*c*) are sectional views for illustrating the airflow in this embodiment. In FIGS. 7(*a*) to 7(*c*), an arrow A represents a gas blowing direction (airflow). In the airflow control in this embodiment, as described above, the airflow is switched depending on the control modes consisting of the stand-by mode, the sheet passing mode and the down time mode.

When the main power switch is turned on (S101), the control circuit portion 31 starts a warming operation of the image forming apparatus 30. In the fixing device 20, the fixing roller 101 and the pressing roller 102 are driven, and heating of the fixing device 20, i.e., heating of the fixing roller 101 is started (S102).

When the heating of the fixing roller 101 is started, the control circuit portion 31 effects detection of the temperature of the heat sink 107 by the thermometer 149 (S103). In the case where the temperature of the heat sink 107 is, e.g., less than 27° C., the airflow is set at a level in the operation in the stand-by mode. In the operation in the stand-by mode, open/close of the shutter 145 is detected (S104). In the case where the shutter is open, the shutter 145 is closed (S105), and then the second fan 144 is driven (S106).

Further, in the case where the temperature of the heat sink 107 is not less than 27° C., the airflow is set at a level in the operation in the down time mode. In the operation in the down time mode, the open/close of the shutter 145 is detected (S107). In the case where the shutter 145 is open, the shutter 145 is closed (S108), and then the first fan 142 and the second fan 144 are driven (S109). Further, the driving motor 139 is turned on the rotate the belts 104*c* and 104*d* until the temperature of the heat sink 107 is less than 27° C. When the temperature of the heat sink 107 is less than 27° C., the driving of the first fan 142 is stopped (S112) and then the driving of the driving motor 139 is stopped (S113).

Next, in the case where a job demand (input of image formation start signal) is made by a user (S114, S115), when the temperature of the heat sink 107 is 27° C. or more, the operation is continued in the down time mode until the temperature of the heat sink 107 becomes less than 27° C. Thereafter, when the heat sink temperature is less than 27° C., the operation enters the sheet passing mode.

On the other hand, in the case where the temperature of the heat sink 107 is less than 27° C., the operation immediately enters the sheet passing mode. In the operation in the sheet passing mode, the shutter 145 is opened (S118) and then the driving of the second fan 144 is stopped. Then, the driving motor 139 is driven (S120) to start the driving of the second fan 144 (S121). When the image forming job is started, the sheet S on which the toner is placed passes through the fixing device 20 and the cooling apparatus 21 (S122). During passage of the sheet S through the cooling apparatus 21, the driving of the first fan 142 is continued.

When the sheet S passes through the cooling apparatus 21, the presence/absence of a subsequent sheet is detected (S123). In the case where the subsequent sheet is present, the temperature of the heat sink 107 is detected (S117). In the case where the temperature of the heat sink 107 is, e.g., 40° C. or more, the image forming job is temporarily stopped, and the operation enters the down time mode. In the operation in the down time mode, the open/close of the shutter 145 is detected (S124). In the case where the shutter 145 is open, the shutter 145 is closed (S125) and then the first fan 142 and the second fan 144 are driven (S126).

Further, the driving roller 106 is continuously driven until the temperature of the heat sink 107 becomes less than 27° C. (S127). When the temperature of the heat sink 107 is less than 27° C., the shutter 145 is opened (S118) and then the second fan 144 is stopped (S119). Thereafter, the subsequent sheet is conveyed (S122).

On the other hand, in the case where the temperature of the heat sink 107 is less than 40° C., the job is not temporarily stopped, and the sheet conveyance is continued to repeat the steps S117 to S123 until the job is ended or the temperature of the heat sink 107 becomes 40° C. or more. When the job is ended, the shutter 145 is closed (S130) to repeat the steps S103 to S131 until a subsequent job is inputted.

During non-use of the image forming apparatus, the power is turned off by the user (S132). In the above steps, the temperatures of 27° C. and 40° C. of the heat sink 107 used for discriminating the control mode switching are values as an example and do not limit a temperature range.

By applying the constitution in this embodiment, the temperature rise by the heat conduction from the fixing device 20 to the cooling apparatus 21 during the operations in the stand-by mode and the down time mode can be reduced.

The temperature increase of the cooling apparatus 21 by the heat conduction from the fixing device 20 was checked. For example, under a condition in which the temperature of the fixing roller 101 is 180° C. and the temperature of the pressing roller 102 is 100° C., the local temperature increase of the cooling apparatus 21 closest to the fixing device 20 was compared by the presence/absence of the air blow to the second air blow path 143. In this case, the closest distance between the fixing device 20 and the cooling apparatus 21 was, e.g., about 55 min.

A result of the temperature increase is shown in FIG. 8. In the case where no air blow to the second air blow path 143 is made, after 240 sec, the temperature of a portion of the rotatable belts 104*c* and 104*d* of the cooling apparatus 21 closest to the fixing device 20 was increased from about 23° C. to about 50° C. On the other hand, in the case where the air blow to the second air blow path 143 is made, it was found that the temperature is not substantially increased. Therefore, in the operations in the control modes during the stand-by and during the down time, by driving the second fan 144, it is possible to effectively suppress the temperature rise of the cooling apparatus 21 by the heat conduction from the fixing device 20.

In the case where the air blowing to the second air blow path 143 is not performed, a portion of the belts 104*c* and 104*d* becomes higher in temperature than other portions. In this state, when the sheet S is conveyed, the high-temperature portion of the belts 104*c* and 104*d* applies a larger heat quantity to the toner image in contact with the toner image on the sheet S. As a result, uneven glossiness appears on the toner image.

On the other hand, by making the air blow to the second air blow path 143, there is substantially no partial temperature difference between the sheets 104*c* and 104*d* which contact the sheet S and therefore it is possible to suppress the uneven glossiness appearing on the toner image on the sheet S.

Further, in the control mode during the down time, e.g., the time required to cool the heat sink 107 so that the temperature of the heat sink 107 of 40° C. as a measured value of the thermometer 149 is decreased to 27° C. was compared between the presence and absence of the air blowing to the second air blow path 143. As a result, in the operation in the control mode during the down time, in the case where no air blowing to the second air blow path 143 was performed, the time was 90 sec, and on the other hand, by making the air blow to the second air blow path 143 in the operation in the control mode during the down time, the heat conduction from the fixing device 20 was suppressed and thus the time was able to be shortened to 70 sec.

Embodiment 2

The image forming apparatus in this embodiment is basically the same as the image forming apparatus 30 (FIG. 1) in Embodiment 1 and therefore will be omitted from redundant description. FIG. 9 is a perspective view of an outer appearance of a principal part of the fixing device 20 and the cooling apparatus 21 provided adjacent to the fixing device 20 in this embodiment, and FIG. 10 is a schematic side view of the principal part of the fixing device 20 and the cooling apparatus 21. The constitution of the fixing device 20 is common to Embodiments 1 and 2 and therefore will be omitted from redundant description. Also the constitution of the cooling apparatus 21 is basically common to Embodiments 1 and 2, and therefore constituent members or portions are represented by the same reference numerals or symbols and will be omitted from redundant description.

In Embodiment 2, in an air blow path 146 of the cooling apparatus 21, a part of the air blow path 146 is common to the first air blow path 141 and the second air blow path 143, and the cooling apparatus 21 includes a fan 147 for sending the gas (air) to a common space. Further, inside the air blow path 146, a movable airflow switching member 148 (FIGS. 11 and 12) is provided, and depending on a position of the airflow switching member 148, the amount (volume) of the gas introduced into the first air blow path 141 and the amount of gas introduced into the second air blow path 143 are changed.

The airflow switching member 148 is movable to first to third (three) positions P1, P2 and P3 by a shifting mechanism (not shown) controlled by the control circuit portion 31. The first position P1 is a position where the gas is introduced into only the first air blow path 141 (FIG. 12(*b*)). The second position P2 is a position where the gas is introduced into only the second air blow path 143 (FIG. 12(*a*)). The third position P3 is a position where the gas is introduced into the first air blow path 141 and the second air blow path 143 (FIG. 12).

At the third position P3, the amount of the gas introduced into the first air blow path 141 is made larger than that introduced into the second air blow path 143 (e.g., 9:1).

FIG. 14 is a schematic perspective view of the airflow switching member 148. In the figure, an arrow C represents a slide direction of the airflow switching member 148. Further, FIGS. 12(*a*)-12(*c*) are sectional views for illustrating the airflow in this embodiment. In these figures, an arrow A represents a gas (air) blow (airflow) direction.

The airflow switching member 148 has a comb-like shape having teeth which have the substantially the same pitch as those of fins of the heat sink 107, and hermetically contacts the heat sink 107 at the second position P2 to block spaces between the fins of the heat sink 107, thus preventing the air blowing to the heat sink 107. In this case, the airflow switch member 148 does not prevent the airflow between the fan 147 and the second air blow path 143.

Further, at the first position P1, the comb-like portion of the airflow switching member 148 is spaced from the fins of the heat sink 107 and therefore does not prevent the air blowing to the heat sink 107. Further, the airflow switching member blocks the airflow between the fan 147 and the second air blow path 143, thus preventing the air blowing to the second air blow path 143. The third position P3 is located between the first position P1 and the second position P2. At the third position P3, the comb-like portion of the airflow switching member (movable member) 148 is spaced from the fins of the heat sink 107 and therefore does not prevent the air blowing to the heat sink 107. Further, the airflow switching member 148 does not sufficiently block the airflow between the fan 147 and the second path 143, so that it is possible to compatibly realize the air blowing to the heat sink 107 and the second air blow path 143.

The airflow control system depending on the state of the job will be described. In the airflow control in this embodiment, the airflow is switched depending on the control modes consisting of the stand-by mode, the sheet passing mode and the down time mode. The position of the air blow path in each of the control modes will be described. The effect and its reason common to Embodiments 1 and 2 will be omitted from description.

a) Case of Stand-by Mode

In the operation in the stand-by mode, the position of the airflow switching member 148 is changed to the second position P2, so that the gas is sent to only the second air blow path 143 (FIG. 12(*a*)).

b) Case of Sheet Passing Mode

In the operation in the sheet passing mode, the position of the airflow switching member 148 is changed to the first position P1, so that the gas is sent to only the first air blow path 141 (FIG. 12(*b*)).

c) Case of Down Time Mode

In the operation in the down time mode, the position of the airflow switching member 148 is changed to the third position P3, so that the gas is sent to both of the first and second air blow paths 141 and 143 (FIG. 12(*c*)).

FIGS. 13 and 11 are flow chart and a block diagram, respectively, of the airflow control system in this embodiment. In the airflow control in this embodiment, as described above, the airflow is switched depending on the control modes consisting of the stand-by mode, the sheet passing mode and the down time mode.

When the main power switch is turned on (S201), the control circuit portion 31 starts a warming operation of the image forming apparatus 30. In the fixing device 20, the fixing roller 101 and the pressing roller 102 are driven, and heating of the fixing device 20, i.e., heating of the fixing roller 101 is started (S202).

When the heating of the fixing roller 101 is started, the control circuit portion effects detection of the temperature of the heat sink 107 by the thermometer 149 (S203). In the case where the temperature of the heat sink 107 is, e.g., less than 27° C., the airflow is set at a level in the operation in the stand-by mode. In the operation in the stand-by mode, open/close of the shutter 145 is detected (S204). In the case where the shutter is open, the shutter 145 is closed (S205). Further, the position of the airflow switching member 148 is changed to the second position P2 (S206), and then the fan 147 is driven at a rotation number Nb (e.g., 10% of its full speed (S207).

Further, in the case where the temperature of the heat sink 107 is not less than 27° C., the airflow is set at a level in the operation in the down time mode. In the operation in the down time mode, the open/close of the shutter 145 is detected (S208). In the case where the shutter 145 is open, the shutter 145 is closed (S209), and the position of the airflow switching member 148 is changed to the third position P3 (S210). Further, the fan 147 is driven at a rotation number Na (e.g., 100% of its full speed (S211).

Further, the driving motor 139 is turned on the rotate the belts 104*c* and 104*d* until the temperature of the heat sink 107 is less than 27° C. (S212). When the temperature of the heat sink 107 is less than 27° C., the rotation number of the fan 147 is changed to Nb (S214), and the position of the airflow switching member 148 is changed to the second operation P2 (S215). Further, the driving of the driving motor 139 is stopped (S216).

Next, in the case where a job demand (input of image formation start signal) is made by a user (S217, S218), when the temperature of the heat sink 107 is 27° C. or more, the operation is continued in the down time mode until the temperature of the heat sink 107 becomes less than 27° C. Thereafter, when the heat sink temperature is less than 27° C., the operation enters the sheet passing mode.

On the other hand, in the case where the temperature of the heat sink 107 is less than 27° C., the operation immediately enters the sheet passing mode. In the operation in the sheet passing mode, the shutter 145 is opened (S221) and then the fan 147 is driven at the rotation number Na (S222). Then, the position of the airflow switching member 148 is changed to the first position P1 (S223) and then, the driving motor 139 is driven (S224). When the job is started, the sheet S on which the toner is placed passes through the fixing device 20 and the cooling apparatus 21 (S225). During passage of the sheet S through the cooling apparatus 21, the driving of the fan 147 is continued at the rotation number Na.

When the sheet S passes through the cooling apparatus 21, the presence/absence of a subsequent sheet is detected (S226). In the case where the subsequent sheet is present, the temperature of the heat sink 107 is detected (S220). In the case where the temperature of the heat sink 107 is, 40° C. or more, the job is temporarily stopped, and the operation enters the down time mode. In the operation in the down time mode, the open/close of the shutter 145 is detected (S227). In the case where the shutter 145 is open, the shutter 145 is closed (S228) and then the position of the airflow switching member 148 is changed (moved) to the third position P3 (S229). Further, the fan 147 is driven at the rotation number Na (S230).

Further, the driving roller 106 is continuously driven until the temperature of the heat sink 107 becomes less than 27° C. (S231). When the temperature of the heat sink 107 is less than 27° C., the shutter 145 is opened (S221) and then the position of the airflow switching member 148 is changed to the first position P1 (S223). Thereafter, the subsequent sheet is conveyed (S225).

On the other hand, in the case where the temperature of the heat sink 107 is less than 40° C., the job is not temporarily stopped, and the sheet conveyance is continued to repeat the steps S220 to S232 until the job is ended or the temperature of the heat sink 107 becomes 40° C. or more. When the job is ended (S233), the shutter 145 is closed (S234) to repeat the steps S203 to S235 until a subsequent job is inputted.

During non-use of the image forming apparatus, the power is turned off by the user (S236).

By applying the constitution in this embodiment, the temperature rise by the heat conduction from the fixing device 20 to the cooling apparatus 21 during the operations in the stand-by mode and the down time mode can be reduced. An effect obtained by employing the constitution in this embodiment is the same as that in Embodiment 1 and therefore will be omitted from description.

Other Embodiments

1) In the cooling apparatus (image heating device) 20, the cooling member for the belt 103*c* is not limited to the heat sink 107 but may also be, e.g., a heat pipe. It is also possible to employ a constitution in which the cooling member is provided also for the belt 104*d* and then the air is sent.

2) The type of the image heating apparatus (image heating device) 20 is not limited to a heating roller type as in Embodiments 1 and 2. It is also possible to use image heating apparatuses having known various constitutions, such as a heat chamber type, infrared irradiation type and electromagnetic heating type.

3) Further, the image heating apparatus 20 is not limited to the fixing device but may also be a gloss-improving apparatus (image-modifying apparatus) for increasing glossiness of the image by re-heating the image fixed on the recording material.

4) The type of the image forming portion of the image forming apparatus is not limited to the electrophotographic type but may also be an electrostatic recording type or a magnetic recording type. Further, the type is not limited to the transfer type but may also be a direct type in which an unfixed image is directly formed on the recording material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 003022/2012 filed Jan. 11, 2012, which is hereby incorporated by reference.

What is claimed is:

1. An image forming apparatus, comprising:

an image heating device configured to heat an image on a sheet;

a cooling belt configured to cool the sheet in contact with the sheet heated by said image heating device;

a heat sink configured to cool said cooling belt;

a first fan configured to generate airflow in said heat sink;

a second fan configured to generate airflow in a space between said image heating device and said cooling belt; and a selector configured to select, depending on the status of said image forming apparatus, a mode from three modes comprising a first mode in which said first fan is actuated without actuating said second fan, a second mode in which said second fan is actuated without actuating said first fan, and a third mode in which said second fan is actuated together with said first fan.

2. An image forming apparatus according to claim 1, further comprising:

a first duct configured to guide the airflow into said heat sink; and a second duct configured to guide the airflow into the space between said image heating device and said cooling belt.

3. An image forming apparatus according to claim 1, wherein said selector selects the first mode when said image forming apparatus is in an image formation state, selects the second mode when said image forming apparatus is in a stand-by state, and selects the third mode when said image forming apparatus is in an image formation-interruption state.

4. An image forming apparatus according to claim 3, further comprising a temperature sensor configured to detect the temperature of said cooling belt, wherein said selector selects the third mode when a detected temperature detected by said temperature sensor is increased up to an upper-limit temperature.

5. An image forming apparatus according to claim 3, further comprising a shutter configured to open and close a sheet conveying path between said image heating device and said cooling belt, wherein said shutter closes the sheet conveying path when said image forming apparatus is in the stand-by state and is in the image formation-interruption state.

6. An image forming apparatus according to claim 3, wherein rotation of said cooling belt is stopped when said image forming apparatus is in the stand-by state.

7. An image forming apparatus according to claim 1, further comprising a conveying belt configured to convey the sheet to said cooling belt in contact with the sheet, wherein said heat sink is provided so as to interpose said cooling belt between itself and said conveying belt.

8. An image forming apparatus according to claim 1, wherein said image heating device fixes an unfixed toner image as the image on the sheet.

9. An image forming apparatus, comprising:

an image heating device configured to an image on a sheet;

a cooling belt configured to cool the sheet in contact with the sheet heated by said image heating device;

a heat sink configured to cool said cooling belt;

a first duct configured to guide the airflow into said heat sink;

a second duct configured to guide the airflow into the space between said image heating device and said cooling belt;

a fan configured to send air to said first duct and said second duct; and a selector configured to select, depending on the status of said image forming apparatus, a mode from three modes comprising of a first mode in which said fan sends the air to said first duct without sending the air to said second duct, a second mode in which said fan sends the air to said second duct without sending the air to said first duct, and a third mode in which said fan sends the air to the second duct together with said first duct.

10. An image forming apparatus according to claim 9, further comprising a movable member provided between said fan and said first and second ducts, wherein said selector switches the position of said movable member depending on the status of said image forming apparatus.

11. An image forming apparatus according to claim 10, wherein said selector selects the first mode when said image forming apparatus is in an image formation state, selects the second mode when said image forming apparatus is in a stand-by state, and selects the third mode when said image forming apparatus is in an image formation-interruption state.

12. An image forming apparatus according to claim 11, further comprising a temperature sensor configured to detect the temperature of said cooling belt, wherein said selector selects the third mode when the detected temperature detected by said temperature sensor is increased up to an upper-limit temperature.

13. An image forming apparatus according to claim 11, further comprising a shutter configured to open and close a sheet conveying path between said image heating device and said cooling belt, wherein said shutter closes the sheet conveying path when said image forming apparatus is in the stand-by state and is in the image formation-interruption state.

14. An image forming apparatus according to claim 11, wherein rotation of said cooling belt is stopped when said image forming apparatus is in the stand-by state.

15. An image forming apparatus according to claim 9, further comprising a conveying belt configured to convey the sheet to said cooling belt in contact with the sheet, wherein said heat sink is provided so as to interpose said cooling belt between itself and said conveying belt.

16. An image forming apparatus according to claim 9, wherein said image heating device fixes an unfixed toner image as the image on the sheet.

17. An image forming apparatus, comprising:

an image forming device configured to form a toner image on a sheet;

an image heating device configured to heat the toner image on the sheet;

a cooling device configured to cool the sheet heated by said image heating device, said cooling device including an endless belt configured to convey the sheet in contact with the sheet and a heat sink provided in said endless belt and configured to cool said endless belt;

a fan configured to generate airflow in a space between said image heating device and said cooling device; and a controller configured to control an operation of said fan, wherein said controller actuates said fan during a stand-by mode, and does not actuate said fan during an image formation mode.

18. An image forming apparatus according to claim 17, wherein said image heating device includes first and second rotatable members configured to convey the sheet at a nip portion therebetween and a heater configured to heat said first rotatable member in the image formation mode, and wherein said heater is configured to be actuated in the stand-by mode to maintain the temperature of said first rotatable member at a predetermined temperature.

19. An image forming apparatus according to claim 17, further comprising another fan configured to generate airflow in said heat sink, wherein said controller actuates said another fan without actuating said fan during the image formation mode, and actuates said fan without actuating said another fan during the stand-by mode.

20. An image forming apparatus according to claim 17, further comprising a detector configured to detect the temperature of said endless belt, wherein said controller interrupts the execution of the image formation mode when the temperature detected by said detector is increased up to an upper-limit temperature in the image formation mode, and wherein said controller actuates said fan and said another fan during an interruption of the image formation mode.

21. An image forming apparatus according to claim 17, further comprising a shutter configured to open and close a sheet conveying path between said image heating device and said cooling device, wherein said shutter closes the sheet conveying path during the stand-by mode and opens the sheet conveying path during the image formation mode.

22. An image forming apparatus according to claim 17, wherein said cooling device includes another endless belt configured to convey the sheet cooperatively with said endless belt therebetween, and wherein said heat sink is disposed so as to interpose said endless belt between itself and said another endless belt.

* * * * *